US010981033B2

(12) United States Patent
Kezirian et al.

(10) Patent No.: US 10,981,033 B2
(45) **Date of Patent: *Apr. 20, 2021**

(54) HEAD AND NECK EXERCISE METHODS

(71) Applicant: Berendo Scientific, LLC, Los Angeles, CA (US)

(72) Inventors: Eric J. Kezirian, Los Angeles, CA (US); Jeffrey J. Christian, Morgan Hill, CA (US); Gary B. Hulme, San Jose, CA (US)

(73) Assignee: Berendo Scientific, LLC, Los Angeles, CA (US)

( * ) Notice: Subject to any disclaimer, the term of this patent is extended or adjusted under 35 U.S.C. 154(b) by 35 days.

This patent is subject to a terminal disclaimer.

(21) Appl. No.: 16/410,570

(22) Filed: May 13, 2019

(65) Prior Publication Data

US 2019/0262662 A1 Aug. 29, 2019

Related U.S. Application Data

(63) Continuation of application No. 13/955,825, filed on Jul. 31, 2013, now Pat. No. 10,335,635.

(51) Int. Cl.

| | |
|---|---|
| ***A63B 23/025*** | (2006.01) |
| ***A63B 21/008*** | (2006.01) |
| *A63B 21/02* | (2006.01) |

(52) U.S. Cl.

CPC ..... *A63B 23/025* (2013.01); *A63B 21/0085* (2013.01); *A63B 21/023* (2013.01); *A63B 21/026* (2013.01)

(58) Field of Classification Search

CPC . A63B 21/0085; A63B 21/026; A63B 21/023; A63B 23/025

See application file for complete search history.

(56) References Cited

U.S. PATENT DOCUMENTS 3,511,228 A 5/1970 Lundgren et al.
4,314,316 A * 2/1982 Gertler ..... G10K 5/00 362/109

(Continued)

FOREIGN PATENT DOCUMENTS

| | | | |
|---|---|---|---|
| EP | 0262239 | A1 | 4/1988 |
| JP | 2001259077 | A | 9/2001 |
| WO | 2004096110 | A2 | 11/2004 |

OTHER PUBLICATIONS

Incentive Spirometer, http://en.wikipedia.org/w/index.php?title=Incentive_spirometer&oldid=531559370 (last visited Jul. 31, 2013).

(Continued)

*Primary Examiner* — Megan Anderson
(74) *Attorney, Agent, or Firm* — Brooks Kushman P.C.

(57) ABSTRACT

Methods for instructing a user to perform head and neck exercises with head and neck apparatuses are disclosed. The apparatus may include a member operatively arranged with a valve mechanism with a threshold pressure. The apparatus may further include an acoustic apparatus, membrane, chromogenic material, or moveable element that may be configured to respond when the pressure within the member is greater in magnitude than the threshold pressure. The head and neck exercise apparatus may also include a member operatively arranged with an acoustic apparatus, membrane, chromogenic material, or moveable element that may be configured, without a valve mechanism, to respond when the absolute pressure within the member is greater in magnitude than a threshold absolute pressure.

27 Claims, 12 Drawing Sheets

(56) References Cited

U.S. PATENT DOCUMENTS

| | | | | |
|---|---|---|---|---|
| 4,444,202 | A | 4/1984 | Rubin et al. | |
| 4,823,828 | A | 4/1989 | McGinnis | |
| 4,981,295 | A | 1/1991 | Belman et al. | |
| 5,213,553 | A * | 5/1993 | Light | A61F 5/58 434/185 |
| 5,507,246 | A | 4/1996 | Rand, Jr. | |
| 9,757,617 | B2 | 9/2017 | Bell | |
| 9,940,918 | B2 | 4/2018 | Ellingson | |
| 2003/0140925 | A1 | 7/2003 | Sapienza et al. | |
| 2005/0045190 | A1 | 3/2005 | Bennett | |
| 2005/0263152 | A1 | 12/2005 | Fong | |
| 2006/0124137 | A1 | 6/2006 | Fong | |
| 2011/0087124 | A1 | 4/2011 | Bohman et al. | |
| 2011/0130249 | A1 | 6/2011 | Mikhailenok et al. | |
| 2011/0237402 | A1 | 9/2011 | Murray | |
| 2012/0000472 | A1 | 1/2012 | Martucci | |
| 2016/0375213 | A1 | 12/2016 | Zlupko | |

OTHER PUBLICATIONS

Carl A. Joubert et al., Swallowing Rehabilitation, United States Statutory Invention Registration, Jul. 2, 1996, Registration No. H1557, 11 pgs.

* cited by examiner

SECTION A-A

SECTION B-B

SECTION B-B

HEAD AND NECK EXERCISE METHODS

CROSS-REFERENCE TO RELATED APPLICATION

This application is a continuation of application Ser. No. 13/955,825, filed Jul. 31, 2013, which is hereby incorporated by reference in its entirety.

BACKGROUND

Sleep disordered breathing, including snoring and obstructive sleep apnea, affects tens of millions of adults in the United States. It is associated with substantial cardiovascular morbidity and mortality, endocrine disturbances, excessive daytime sleepiness, quality of life and performance deficits, and motor vehicle crashes.

Multiple factors contribute to sleep disordered breathing, including the loss of muscle tone that occurs with sleep onset. The breathing passages of the upper airway, including the nose, oral cavity, and pharynx, are surrounded by muscles and other soft tissues of the head and neck. This loss of muscle tone enables collapse or vibration of these soil tissues, particularly in the oral cavity and pharynx, contributing to sleep disordered breathing. Treatment of sleep disordered breathing includes approaches that directly or indirectly enlarge or stabilize the breathing passages of the upper airway. Treatment options include behavioral measures such as weight loss, positive airway pressure therapy, surgery, and oral appliances. All treatments have strengths and weaknesses, whether limited compliance, risks of complications, or outcomes that can vary widely.

Head and neck exercises have been proposed as an alternative treatment for sleep disordered breathing. These isotonic and/or isometric exercises can involve muscles within and surrounding the oral cavity and/or pharynx. A number of the exercises include the generation of positive or negative pressure within the oral cavity and/or pharynx.

DETAILED DESCRIPTION

Figure 1A:
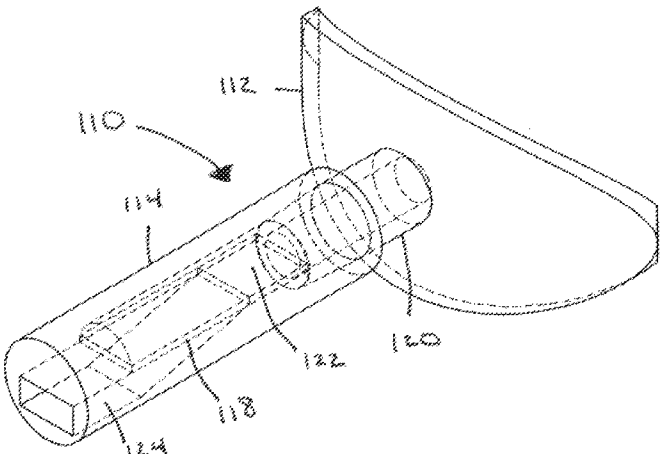
FIG. 1A is a perspective view of a head and neck exercise apparatus.
Figure 1B:
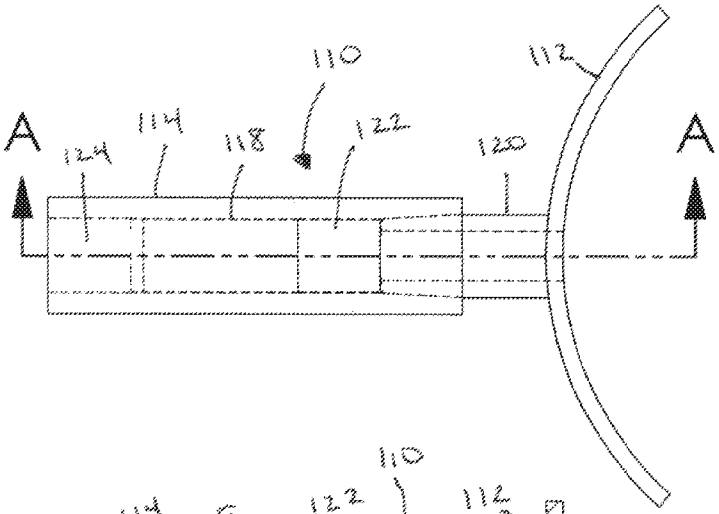
FIG. 1B is a top view of the head and neck exercise apparatus in FIG. 1A.
Figure 1C:
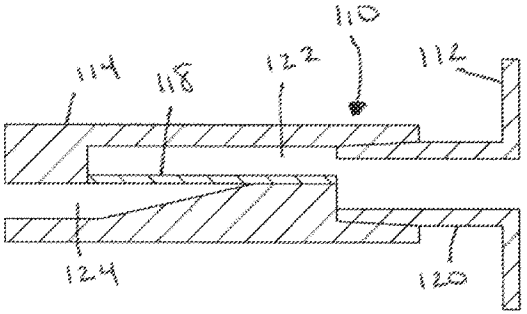
FIG. 1C is a cross-sectional side view of the head and neck exercise apparatus FIG. 1A with a closed valve mechanism.
Figure 1D:
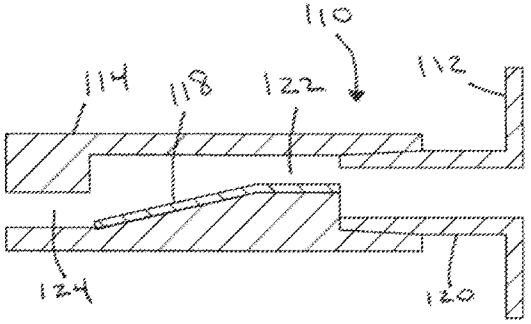
FIG. 1D is a cross-sectional side view of the head and neck exercise apparatus in FIG. 1A with an open valve mechanism.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details. Therefore, specific structural and functional details disclosed herein are not to be interpreted as limiting, but merely as a representative basis for teaching one skilled in the art to employ variously the present invention.

Referring to all Figures and embodiments described in this application, similarly-numbered parts (e.g., 118, 218, 418, etc.) may have similar descriptions, designs, and embodiments.

Referring to FIGS. 1A, 1B, 1C, and 1D, an embodiment of a head and neck exercise apparatus 110 may be used in the performance of isotonic and/or isometric head and neck exercises for sleep disordered breathing. These exercises can include the generation of positive or negative pressure within the oral cavity and/or pharynx. These exercises may improve sleep disordered breathing through a number of mechanisms, including building muscle strength, increasing or coordinating muscle activity, changing soft tissues characteristics, and improving what may be improper position of anatomic structures of the head and neck. Analogous to traditional weight lifting and resistance exercises for muscles in other areas of the body, the use of head and neck exercises apparatuses that provide consistent resistance training and feedback could provide a number of benefits, including facilitating exercise performance and monitoring.

The head and neck exercise apparatus 110 may include a mouthpiece 112 that cooperates with a proximal portion 122 of a member 114. In this embodiment, the member 114 is cylindrically-shaped and defines a passageway or proximal portion 122 there through. In this embodiment, the member 114 also defines a passageway or distal portion 124 there through. A valve mechanism 118 may be operatively arranged with (e.g., disposed within, connected to, etc.) the member 114. The valve mechanism 118 may separate the proximal portion 122 and distal portion 124 when in the closed position. In certain embodiments, the valve mechanism 118 is biased towards the closed position (FIG. 1C) unless it is opened (FIG. 1D) while the positive pressure in the proximal portion 122 is greater than a threshold pressure (e.g., 0.7 pounds per square inch), such threshold pressure to be determined by the properties of the member 114 (e.g., dimensions, etc.) and/or valve mechanism 118 (e.g., stiffness, thickness, etc.) For example, if the pressure in the proximal portion 122 rises above the threshold pressure to open the valve mechanism 118 but subsequently falls below the threshold pressure, the valve mechanism 118 closes.

The valve mechanism 118 is presented as of the deflection valve type, but other valve mechanism types such as reed valve, leaf valve, duckbill valve, ball valve, check valve, gate valve, plug valve, and diaphragm valve, are possible. In other embodiments, the valve mechanism 118 may open if the pressure in the proximal portion 122 rises above the threshold pressure but then remains open if the pressure in the proximal portion 122 subsequently falls below the threshold pressure. The valve mechanism may include sonic means to return the valve to the closed position (e.g., reset lever, etc.). In other embodiments, the valve mechanism 118 may be biased towards the open position unless it is closed when the positive pressure in the proximal portion 122 is greater than a threshold pressure, with all other potential configurations described elsewhere in this application. In other embodiments, the valve mechanism 118 may be biased towards the closed position and open only if negative pressure in the proximal portion 122 has an absolute pressure greater than a threshold negative pressure (i.e., is less than a threshold negative pressure). All other embodiments described for positive pressure in the proximal portion could be configured for negative pressure. In this application, an absolute pressure greater than a threshold absolute pressure represents a positive pressure greater than a threshold pressure or a negative pressure less than a threshold negative pressure.

Apparatuses for head and neck exercises for sleep disordered breathing ideally provide feedback regarding proper performance of the exercises. As opposed to traditional muscle strength training exercises where gross body movements enable monitoring of the exercise, a user does not easily visualize many head and neck muscles during movement or contraction. Feedback from an apparatus for head and neck exercises for sleep disordered breathing may indicate correct movements or muscle contractions through a number of means, including those that depend on generation of positive or negative pressure within the oral cavity and/or pharynx of a sufficient magnitude or duration.

When the valve mechanism 118 is open, the proximal portion 122 is fluidly connected to the distal portion 124, and airflow may occur between the proximal portion 122 and the distal portion 124. This airflow (from the proximal portion 122 to distal portion 124 with an open valve mechanism 118) could provide simple and immediate user feedback to indicate that there was positive pressure above the threshold pressure.

User feedback could be based on airflow through an apparatus or any sensory signal (visual, auditory, or tactile). The simplicity of the valve mechanism 118 avoids the need for a pressure transducer or other means that may be complex or expensive, as in many medical apparatuses that may emphasize precision over simplicity and low cost. Simplicity and low cost are much more important for head and neck exercises for sleep disordered breathing than in most medical applications. For example, a user may perform these exercises in a wide range of settings over a period of time, where inexpensive and easily portable apparatuses would be favored.

A number of respiratory apparatuses used in medical environments are capable of monitoring positive or negative pressure, but these may not be well-suited to the performance of these head and neck exercises for sleep disordered breathing. Respiratory apparatuses are often developed for disorders affecting the lungs rather than the oral cavity and/or pharynx. This leads to features, such as freely permitting airflow through the apparatus (in order to monitor airflow without disturbance), that may be unfavorable for some head and neck exercises for sleep disordered breathing. These apparatuses or their feedback mechanisms may be expensive or complex, require electrical parts, or be designed to offer precision in measurements of pressure or airflow. These features may not be necessary with exercises for sleep disordered breathing. These and other limitations may have prevented the use of respiratory apparatuses in head and neck exercises for sleep disordered breathing and treatment of many other conditions.

Exercise apparatuses used in other areas of the body (for example, including weights) have been adapted for use in the head and neck region, but their uses have been limited to strengthening muscles for chewing or teeth clenching that may not be suited to exercises for sleep disordered breathing. The unique nature of head and neck exercises for sleep disordered breathing requires different apparatus designs.

Three types of apparatuses have been proposed for head and neck exercises for sleep disordered breathing: (1) brushes or apparatuses with a roughly linear, solid design that can stroke or brush the tongue; (2) tubes designed for drawing liquid from a container connected to a pressure transducer; and (3) positive end-expiratory pressure relief valves utilizing a coil spring mechanism. There are a number of limitations of these apparatuses. The first type is not designed for resistance training exercises and does not provide meaningful feedback regarding many of these exercises. The second is unnecessarily complex and expensive, which may not be favorable for many reasons, including those outlined above.

Positive end expiratory pressure relief valves have been proposed for expiratory muscle training, primarily for disorders affecting the lungs such as chronic obstructive pulmonary disease. These apparatuses provide resistance training for the chest wall muscles relevant to these pulmonary disorders, with the threshold pressure level determined with a coil spring mechanism that enables adjustment over a wide (and continuous) range. These apparatuses have a number of limitations for the treatment of sleep disordered breathing.

First, they have been used solely in expiration, which involves the generation of positive pressure within the body only. In addition, the end-expiratory pressure relief valve apparatuses have solely relied on airflow (e.g., air flows through the apparatus when the expiratory pressure exceeds the threshold pressure) to provide user feedback.

For some exercises and exercise programs, requiring airflow may not be favorable (airflow can only be maintained for a limited duration, airflow may distract the user from any additional movements that are required, etc.). A coil spring mechanism may have technical drawbacks compared to other designs. The wide range of adjustment may be well-suited to chronic obstructive pulmonary disease in which an exercise program generally consists of a single exercise, but exercises for sleep disordered breathing typically involve a number of exercises in which complexity (e.g., an apparatus with a threshold pressure that must be adjusted) may not be favorable. In contrast, a selected range of similar apparatuses with different threshold pressures is more straightforward and enables the construction of simpler apparatuses. There are other limitations and drawbacks of apparatuses that are available currently.

The valve mechanism 118 may have any design that performs the functions as specified. In other embodiments, the valve mechanism 118 may have a means of adjustment to alter its properties (e.g., dimensions, resistance to opening, etc.). In other embodiments, the valve mechanism 118 may be dependent on either positive or negative pressure. In other embodiments, the head and neck exercise apparatus 110 may be configured to allow substitution of the valve mechanism 118. In other embodiments, the member 114 may have no distal portion 124, enabling the proximal portion 122 to communicate directly to the external environment when the valve mechanism 118 is open.

The mouthpiece 112 may be placed between the lips such that it extends inside the oral cavity to assist with maintaining the apparatus position or achieving an airtight communication with the oral cavity. The mouthpiece 112 may be of any configuration or placement (to the lips, between the lips, inside the cheeks, between the teeth, above the tongue, etc.). The mouthpiece 112 may be configured to favor an orientation of at least one structure of the face or oral cavity. Such an orientation could be desirable in the performance of head and neck exercises for sleep disordered breathing.

The mouthpiece 112 may be separable from the member 114 and may include a coupling element 120 that cooperates with the member 114. In this embodiment, the coupling element 120 defines a passageway there through. The coupling element 120 and the remainder of the mouthpiece 112 may be separable. In other embodiments, the mouthpiece 112 may not be separable from the member 114 or may be manufactured in continuity with the member 114. In other embodiments, any suitable mouthpiece 112 or design of the member 114 may be used as an interface between the user and apparatus. A locking or snap mechanism may enhance the cooperation between at least two of the mouthpiece 112, coupling element 120, and member 114.

Figure 2B:
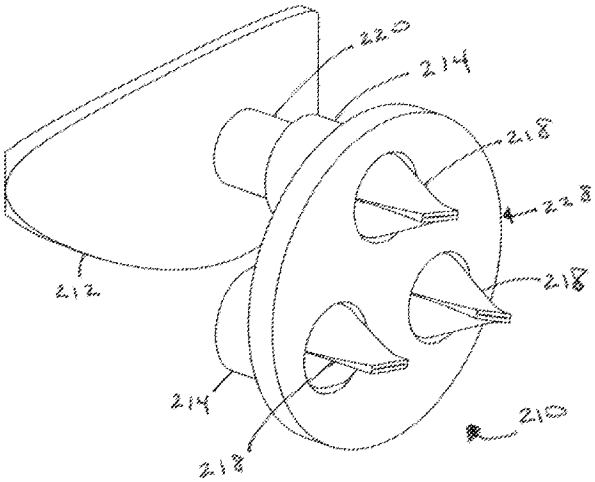
FIG. 2B is a perspective view of the assembled head and neck exercise system in FIG. 2A.
Figure 2A:
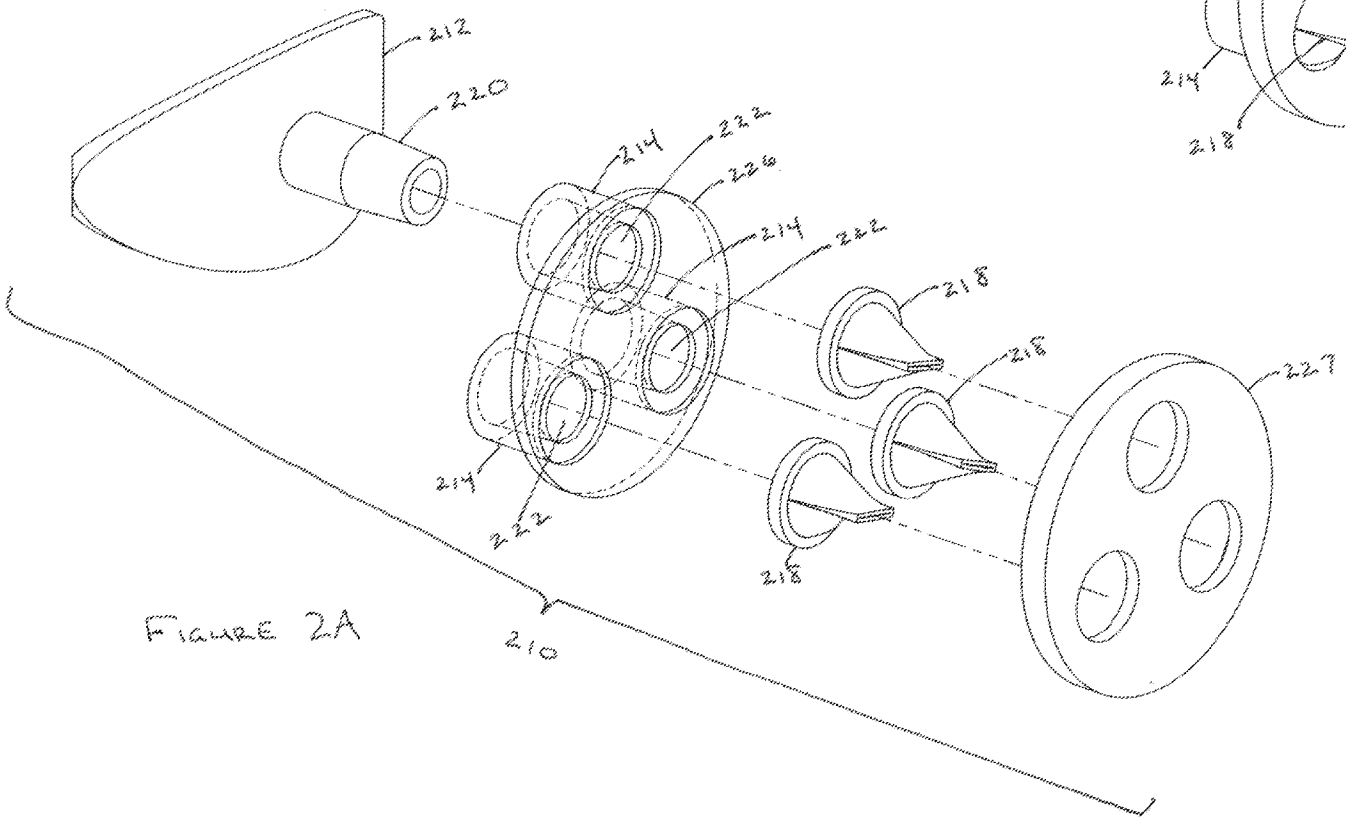
FIG. 2A is an exploded view of a head and neck exercise system.

Referring to FIGS. 2A and 2B, an embodiment of a head and neck exercise system 210 is shown. The head and neck exercise system 210 may include at least two members 214, each with a valve mechanism 218, within a proximal housing 226. The proximal housing 226 may interface with a distal housing 227. When assembled, the at least two members 214 and valve mechanisms 218 may be disposed within a combined housing 228. Other embodiments may include other numbers and/or configuration of housings.

In this embodiment, the valve mechanisms 218 are distinct from the proximal housing 226 and distal housing 227, but in other embodiments any component of the valve mechanism may be manufactured in continuity with any part of the members 214 or housing. In this embodiment, the at least two members 214 each define a proximal portion 222 but do not define a distal portion. In other embodiments, at least one member 214 may define a distal portion.

A mouthpiece 212 may include a coupling element 220 to enable connection to the proximal portion 222 of the at least two members 214. Connection of the mouthpiece 212 to the at least two members 214 may allow the user to perform exercises according to the properties of the at least two members 214. This configuration could provide a range of threshold pressures that could be desirable in the performance of head and neck exercises for sleep disordered breathing. An exercise program may incorporate exercises that require different threshold pressures, and an apparatus with a range of threshold pressures or multiple apparatuses would reduce the need for adjustment or calibration of any single apparatus 210 with a single member 214. Adjustment and calibration can introduce cost, complexity, and expenditure of time and effort, any of which may be undesirable.

In other embodiments, the head and neck exercise apparatus 210 may include at least two mouthpieces 212. In other embodiments, the head and neck exercise apparatus 210 may include a mechanism for substitution of at least one of the member 214 or valve mechanism 218.

Figure 3A:
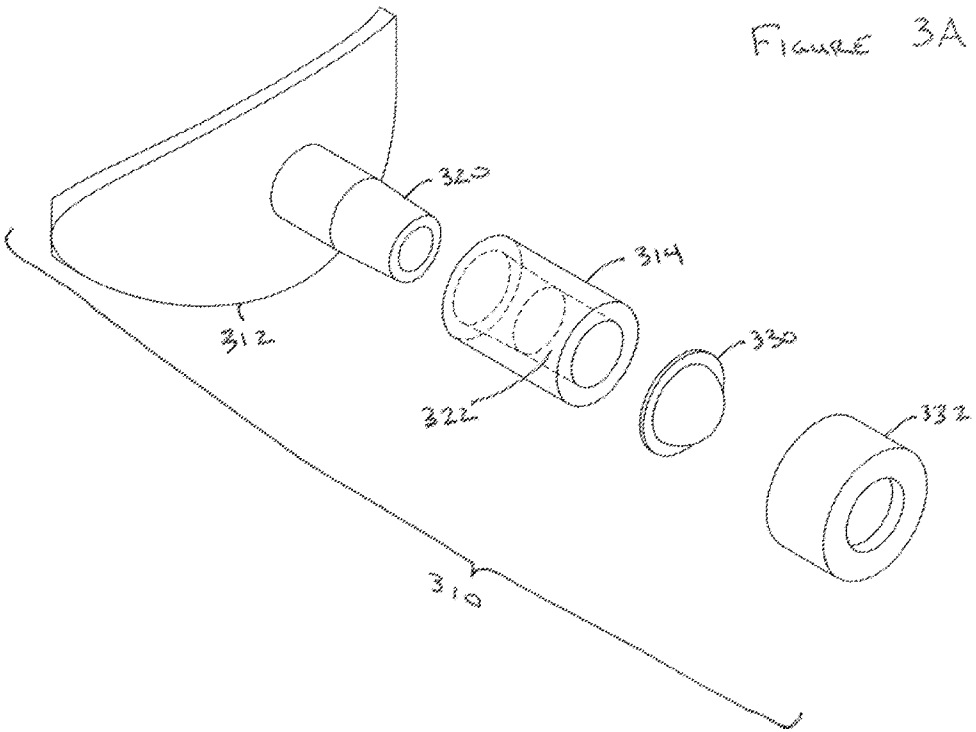
FIG. 3A is an exploded view of another head and neck exercise apparatus.
Figure 3C:
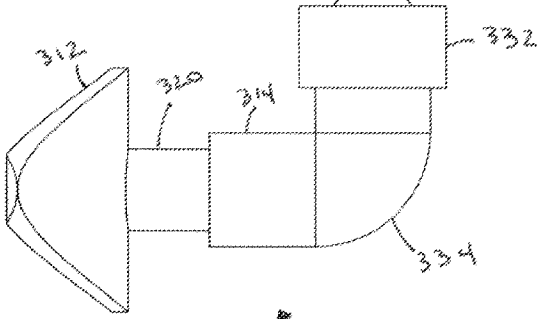
FIG. 3C is a side view of another assembled head and neck exercise apparatus, similar to the apparatus of FIG. 3A.
Figure 3B:
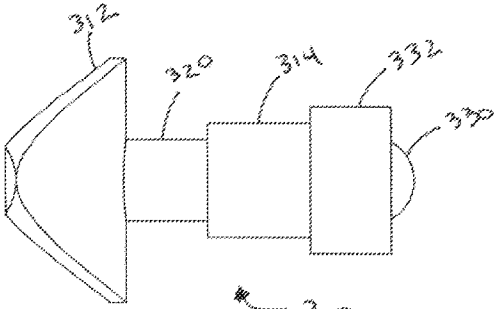
FIG. 3B is a side view of the assembled head and neck exercise apparatus in FIG. 3A.

Referring to FIGS. 3A and 3B, another embodiment of a head and neck exercise apparatus 310 is shown. A member 314 may be operatively arranged with a membrane 330 that may be secured in position with a cap 332. The membrane 330 and a cap 332 may be configured to cover a generally annular open area in the member 314. The membrane 330 may be impermeable or semi-permeable. Positive or negative pressure in a proximal portion 322 of the member 314 may result in outward or inward movement, respectively, of the membrane 330. The pressure required for movement of the membrane 330 or other indication of pressure within the proximal portion 322 of the member 314 may depend on the properties of the member 314 or the membrane 330. A mouthpiece 312 may include a coupling element 320 to enable connection to the member 314. Other embodiments include other methods of securing the membrane 330 to the member 314 such as adhesive, manufacturing as a single unit, etc. Referring to FIG. 3C, another embodiment may include an angled portion 334 of the member 314. This may facilitate visualization of the membrane 330 by the user. The member may or may not include a valve mechanism (not shown), with all configurations described elsewhere in this application. In other embodiments, the membrane 330 may represent a chromogenic material or other means to respond to changes in pressure within the member 314 through other means (e.g., color, shape, etc.).

Figure 4B:
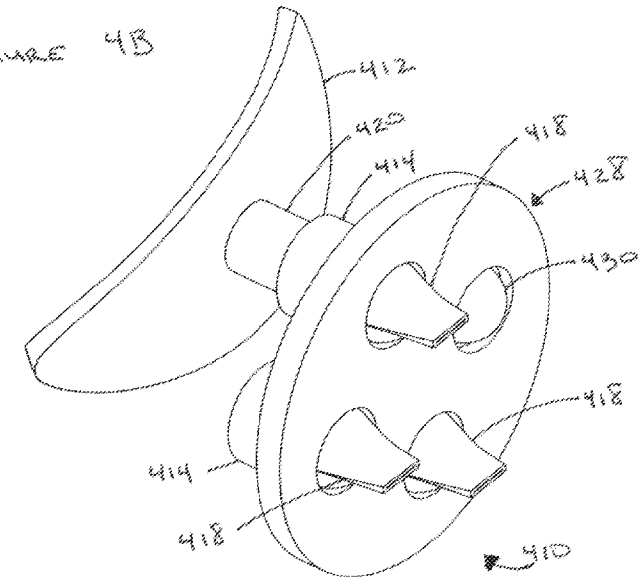
FIG. 4B is a perspective view of the assembled head and neck exercise system in FIG. 4A.
Figure 4A:
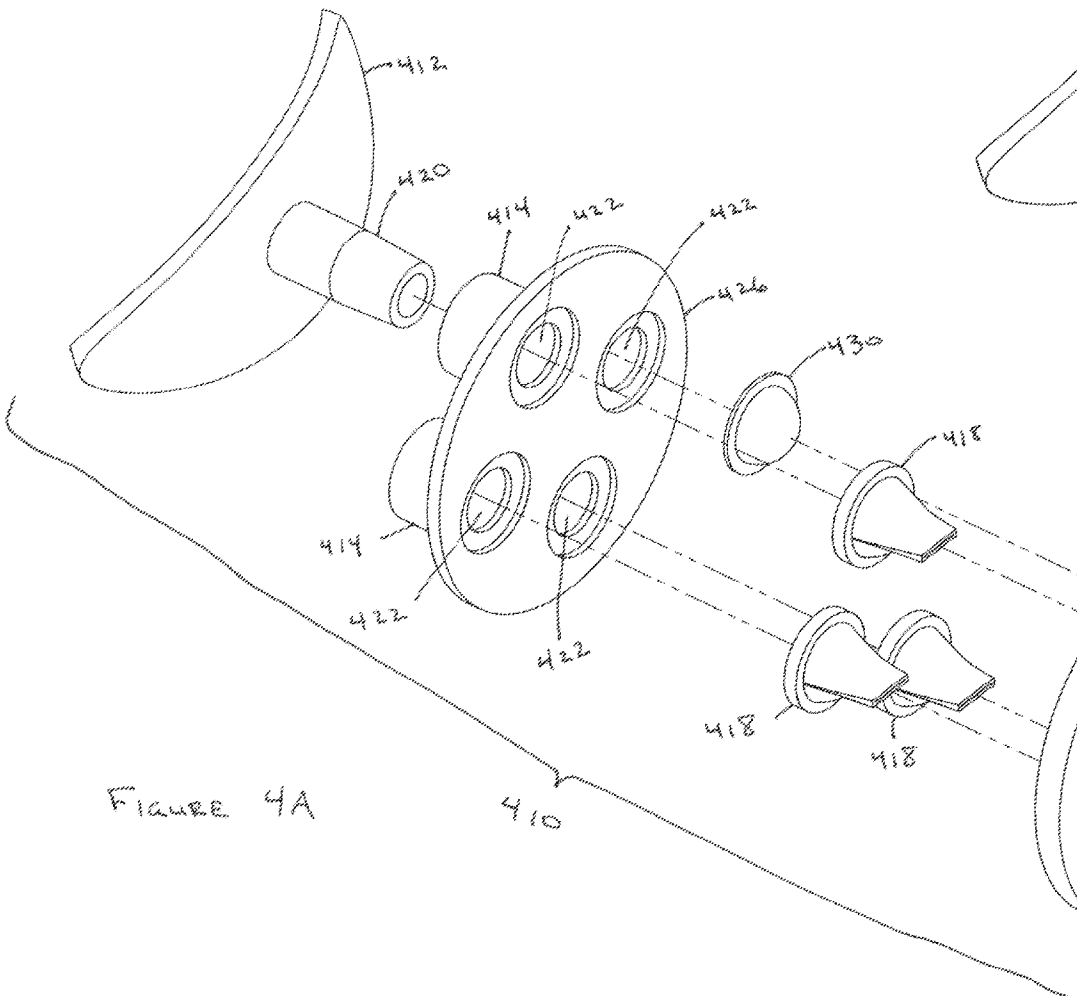
FIG. 4A is an exploded view of another head and neck exercise system.

Referring to FIGS. 4A and 4B, another embodiment of a head and neck exercise system 410 is shown. The head and neck exercise system 410 may include a combination of at least two members 414 with or without a valve mechanism 418 and with or without a membrane 430. A mouthpiece 412 may include a coupling element 420 to enable connection to the at least two members 414. Each member 414 may contain a proximal portion 422 and may be of any design (e.g., to perform exercises involving positive or negative pressure, incorporating other feedback or signaling mechanisms, etc.). The at least two members 414 may be disposed within a proximal housing 426. This proximal housing 426 may interface with a distal housing 427. When assembled, the at least two members 414 and valve mechanisms 418 may be disposed within a combined housing 428. Other embodiments may include other numbers and/or configuration of housings.

In this embodiment, the valve mechanisms 418 are distinct from the proximal housing 426 and distal housing 427, but in other embodiments any component of the valve mechanism may be manufactured in continuity with any part of the members 414 or housing. In this embodiment, the at least two members 414 each define a proximal portion 422 but do not define a distal portion. In other embodiments, at least one member 414 may define a distal portion.

Figure 5B:
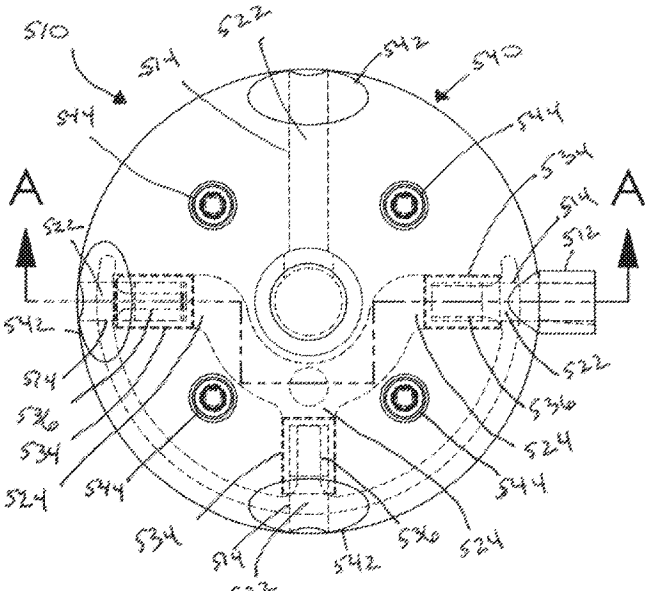
FIG. 5B is a top view of the assembled head and neck exercise system in FIG. 5A.
Figure 5C:
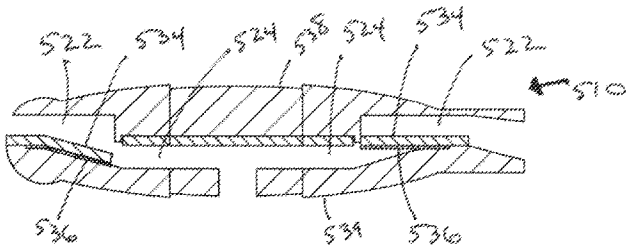
FIG. 5C is a cross-sectional side view of the head and neck exercise system in FIG. 5A with an open and a closed valve mechanism.
Figure 5A:
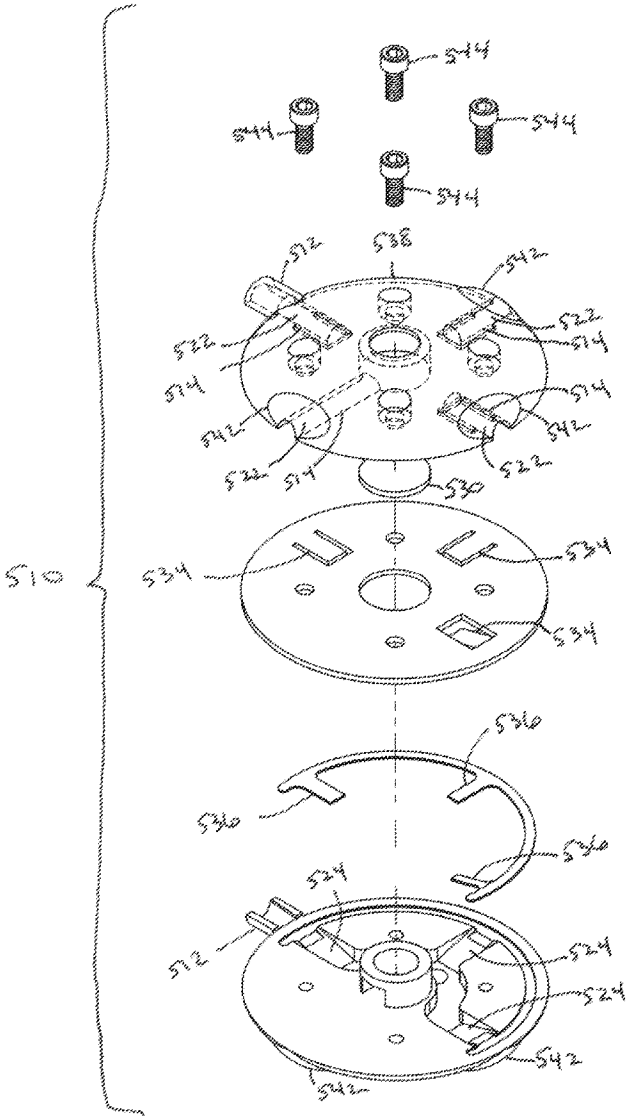
FIG. 5A is an exploded view of another head and neck exercise system.

Referring to FIGS. 5A, 5B, and 5C, another embodiment of a head and neck exercise system 510 is shown. The head and neck exercise apparatus 510 may include a combination of at least two members 514, for example at least two members 514 with a valve mechanism 518; at least one member 514 with a valve mechanism 518 and at least one member 514 without a valve mechanism and with a membrane 530; or any configuration described elsewhere.

A sealing element 534 may be disposed within at least one member 514 to function with a spring element 536. The sealing element 534 may separate a proximal portion 522 and a distal portion 524 of the member 514 when in the closed position (FIG. 5C, right). A spring element 536 (reed spring, leaf spring, compression spring, tension spring, variable spring, etc.) may hold the sealing element 534 biased towards a closed position (FIG. 5C, right) until the positive pressure in the proximal portion 522 of the member 514 exceeds a threshold pressure level to open the sealing element 534 and spring element 536 (FIG. 5C, left). The sealing element 534 and spring element 536 may thus form a valve mechanism, with all other potential configurations described elsewhere in this application.

The threshold pressure levels of the members 514 may be differentiated by at least one characteristic (dimensions, rigidity, etc.) of any portion of the member 514, including the sealing element 534 or spring element 536. The sealing elements 534 can be fashioned together (shown in the Figures), individually, or in continuity with other parts. The spring elements 536 can be fashioned together (shown in the Figures), individually, or in continuity with other parts. Other designs that function similarly to a valve mechanism are possible.

In this embodiment, the head and neck exercise system 510 may include a superior housing 538 that may include at least one of the proximal portion 522 or distal portion 524 of the member 514. An inferior housing 539 may also include at least one of the proximal portion 522 or distal portion 524 of the member 514. In this embodiment, the superior housing 538 and inferior housing 539 define passageways that are the proximal portion 522 and distal portion 524 of the member 514. Other configurations described elsewhere are possible. The superior housing 538 and inferior housing 539 may interface with the use of at least one securing element 544 to assemble as a combined housing 540. Other embodiments may include other numbers and/or configuration of housings. The securing element 544 may be of any form (locking, screw, snap, rivet, etc.).

The distal portion 524 of at least one member 514 may be in communication with at least one other distal portion 524 of another member 514. The head and neck exercise apparatus 510 may include a boss 542 that is contoured for a user to place directly against their lips or a portion of their oral cavity. Other embodiments may include the use of a mouthpiece 512 that may include one or more parts. The boss 542 or mouthpiece 512 may be placed between the lips such that it extends inside the oral cavity to assist with maintaining the apparatus position or achieving an airtight communication with the oral cavity. The boss 542 or mouthpiece 512 may be of any configuration or placement (to the lips, between the lips, inside the cheeks, between the teeth, above the tongue, etc.). The boss 542 or mouthpiece 512 may be configured to favor an orientation of at least one structure of the face or oral cavity. Such an orientation could be desirable in the performance of head and neck exercises for sleep disordered breathing.

Figure 6B:
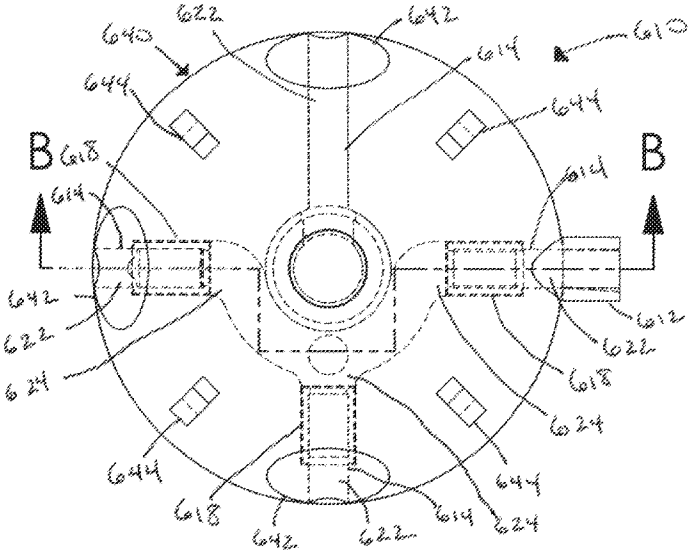
FIG. 6B is a top view of the assembled head and neck exercise system in FIG. 6A.
Figure 6C:
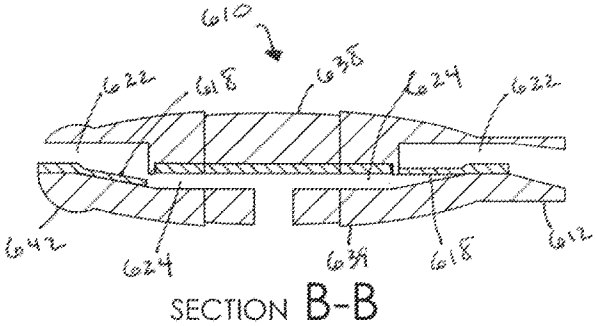
FIG. 6C is a cross-sectional side view of the head and neck exercise system in FIG. 6A with an open and a closed valve mechanism.
Figure 6A:
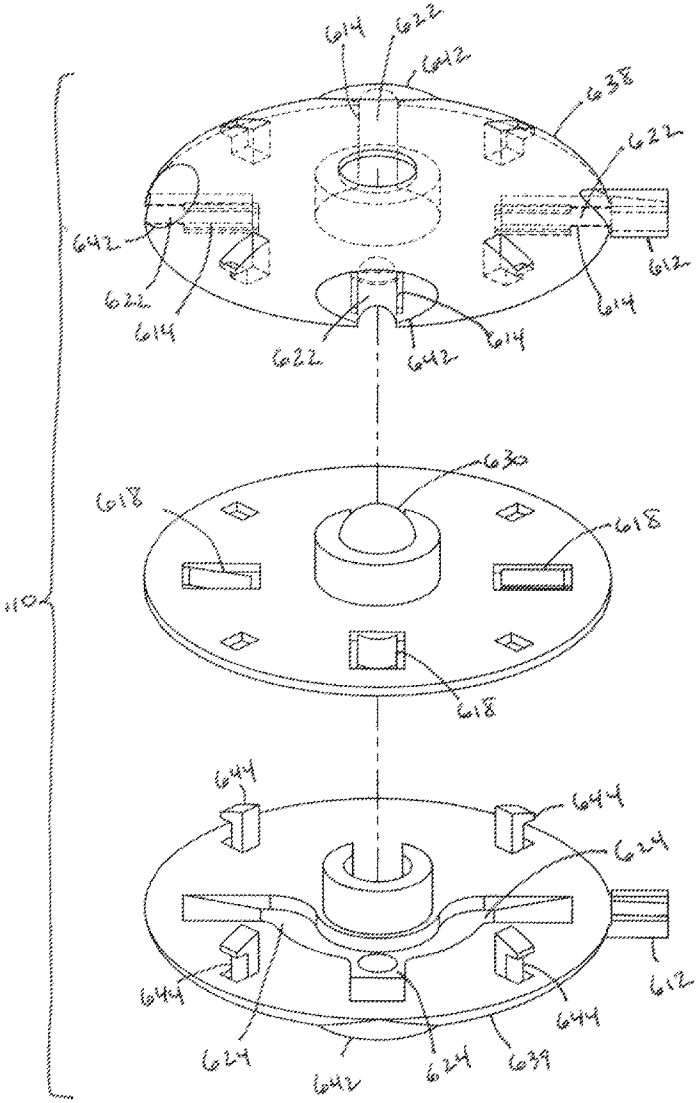
FIG. 6A is an exploded view of another head and neck exercise system.

Referring to FIGS. 6A, 6B, and 6C, another embodiment of a head and neck exercise system 610 is shown. The head and neck exercise system 610 may include a combination of at least two members 614 with any configuration described elsewhere. Each member may include a valve mechanism 618 configured to be biased towards a closed position (FIG. 6C, right) unless it is opened (FIG. 6C, left) when the positive pressure in the proximal portion 622 exceeds a threshold pressure, such threshold pressure to be determined by the properties of the member 614 and valve mechanism 618.

The head and neck exercise apparatus 610 may include at least one member 614 that does not include the valve mechanism 618. The head and neck exercise system 610 may include at least one member 614 with an open area that may be covered by a membrane 630. All configurations described elsewhere are applicable.

The head and neck exercise system 610 may include a superior housing 638 that may include at least one of a proximal portion 622 or distal portion 624 of the at least two members 614. An interior housing 639 may also include at least one of a proximal portion 622 or distal portion 624 of the at least two members 614. The superior housing 638 and inferior housing 639 may interface to assemble as a combined housing 640. The interface between inferior housing 638 and superior housing 639 may include al least one securing element 644 (e.g., locking screw, snap, rivet, etc.) that may help to maintain their physical relationship. At least one member 614 may include a boss 642 or a mouthpiece 612, with all configurations described elsewhere in this application. Other embodiments may include other numbers and/or configuration of housings.

Figures 7A, 7B:
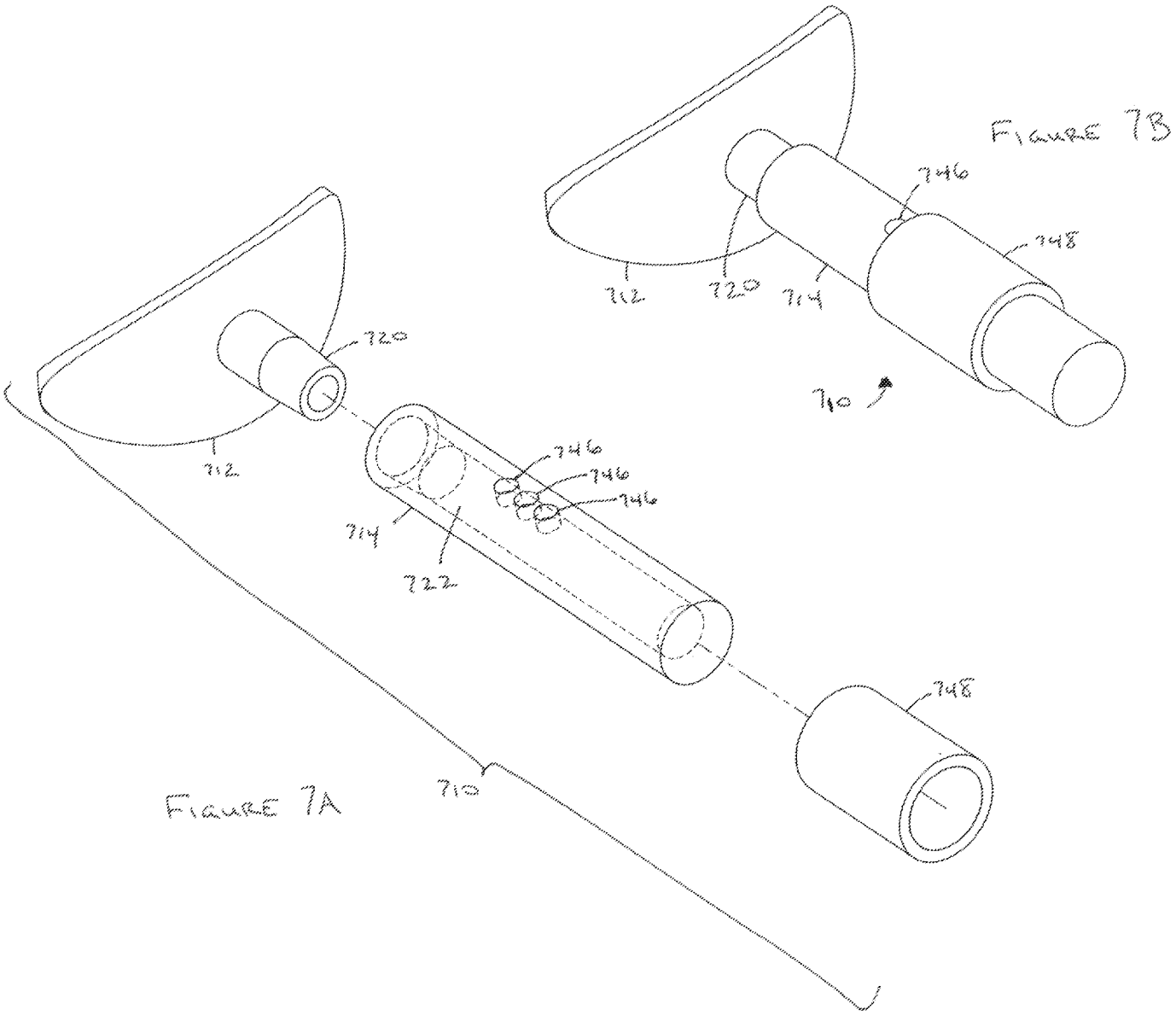
FIG. 7A is an exploded view of another head and neck exercise apparatus.
FIG. 7B is a perspective view of the assembled head and neck exercise apparatus in FIG. 7A.
Figure 8A:
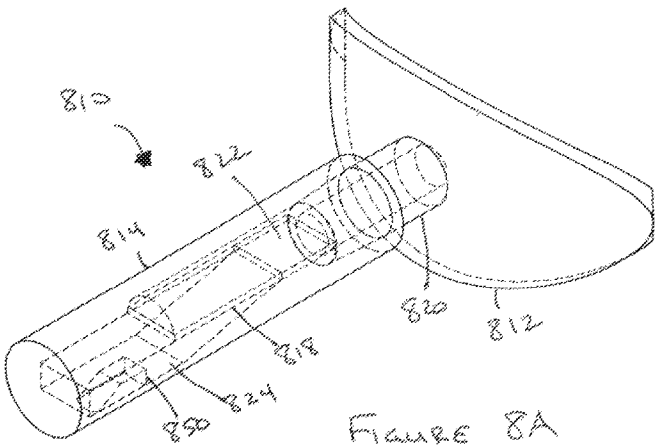
FIG. 8A is a perspective view of another head and neck exercise apparatus.
Figure 8D:
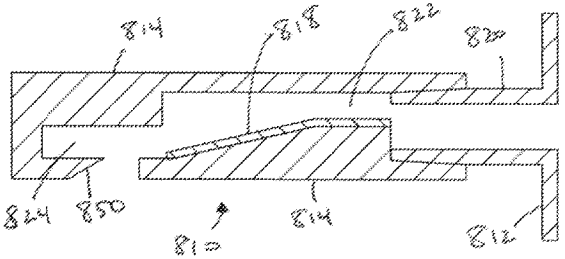
FIG. 8D is a cross-sectional side view of the assembled head and neck exercise apparatus in FIG. 8A with an open valve mechanism.
Figure 8B:
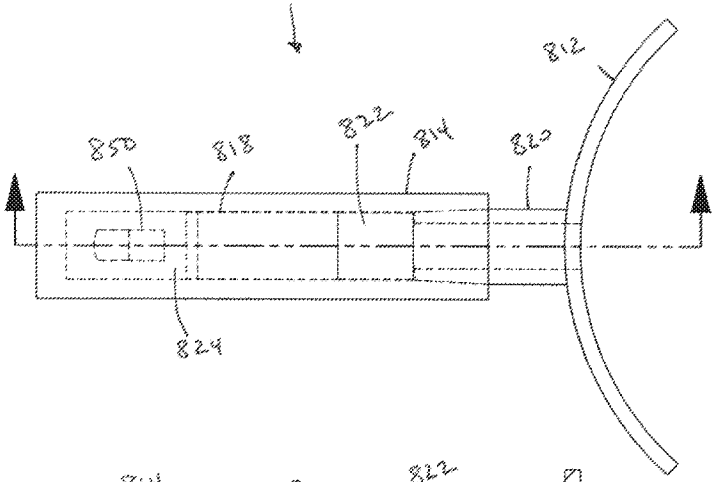
FIG. 8B is a top view of the assembled head and neck exercise apparatus in FIG. 8A.
Figure 8C:
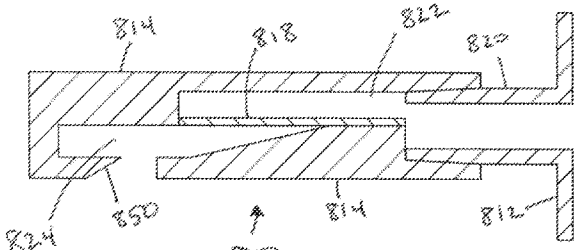
FIG. 8C is a cross-sectional side view of the assembled head and neck exercise apparatus in FIG. 8A with a closed valve mechanism.

Referring to FIGS. 7A and 7B, another embodiment of a head and neck exercise apparatus 710 is shown. The member 714 includes an open proximal portion 722 and may have a sealed distal end. A mouthpiece 712 may include a coupling element 720 to enable connection to the proximal portion 722 of the member 714. The head and neck exercise apparatus 710 may include a member 714 with at least one air passage opening 746. The at least one air passage opening 746 may permit airflow freely through it or may include some resistance to airflow (e.g. resistance valve, semi-permeable material, etc.). Airflow through the at least one air passage opening 746 may be adjusted with a resistance adjustor 748 that may partially or completely occlude the at least one air passage opening 746. In this embodiment, the member 714 and resistance adjustor 748 are both cylindrically-shaped, with the resistance adjustor 748 having a larger diameter in order to enable the resistance adjustor to slide over the member; other embodiments may include other configurations. Airflow through the at least one air passage opening 746 may also be adjusted by modifying, the properties of the at least one air passage opening 746. The resistance adjustor 748 may exist in a sliding relationship and may include a means (e.g., preset locations, etc.) to secure the resistance adjustor 748 in specific positions (e.g.

corresponding to specific changes in total dimensions of the at least one air passage opening 746).

Referring to FIGS. 8A, 8B, 8C, and 8D, another embodiment of a head and neck exercise apparatus 810 is shown. The head and neck exercise apparatus 810 may include a member 814 that is operatively arranged with an acoustic apparatus 850. A valve mechanism 818 may be disposed within the member 814. The valve mechanism 818 may separate a proximal portion 822 and distal portion 824 when in the closed position. A mouthpiece 812 may include a coupling element 820 to enable connection to the member 814.

The acoustic apparatus 850 may be capable of generating an acoustic signal (e.g., whistle, reed, vibrating mechanism, etc.). The acoustic apparatus 850 could therefore provide an acoustic signal as feedback to the user when the valve mechanism 818 is open (FIG. 8D), indicating that the positive pressure in the proximal portion 822 has exceeded a threshold pressure. All potential configurations of the valve mechanism 818 described elsewhere are possible. The acoustic apparatus 850 could be configured to produce acoustic signals with different sound characteristics (frequency, amplitude, etc.) that vary according to characteristics of the pressure generated by the user within their oral cavity and/or pharynx.

In other embodiments, the member 814 could include the acoustic apparatus 850 without a valve mechanism 818. In other embodiments, the acoustic apparatus 850 could be configured to generate an acoustic signal in response to specific positive and/or negative pressures (including configuration with a threshold pressure) within the member 814. In other embodiments, the member 814 could incorporate at least one air passage opening (not shown) and a resistance adjustor (not shown), with all configurations described elsewhere in this application.

Referring to FIGS. 9A, 9B, 9C, and 9D, another embodiment of a head and neck exercise apparatus 910 is shown. The head and neck exercise apparatus 910 may include a member 914 that is operatively arranged with a moveable element 952. A valve mechanism 918 may be disposed within the member 914. The valve mechanism 918 may separate a proximal portion 922 and distal portion 924 when in the closed position. The member 914 and valve mechanism 918 may have any configuration described elsewhere. A mouthpiece 912 may include a coupling element 920 to enable connection to the member 914.

Figure 9A:
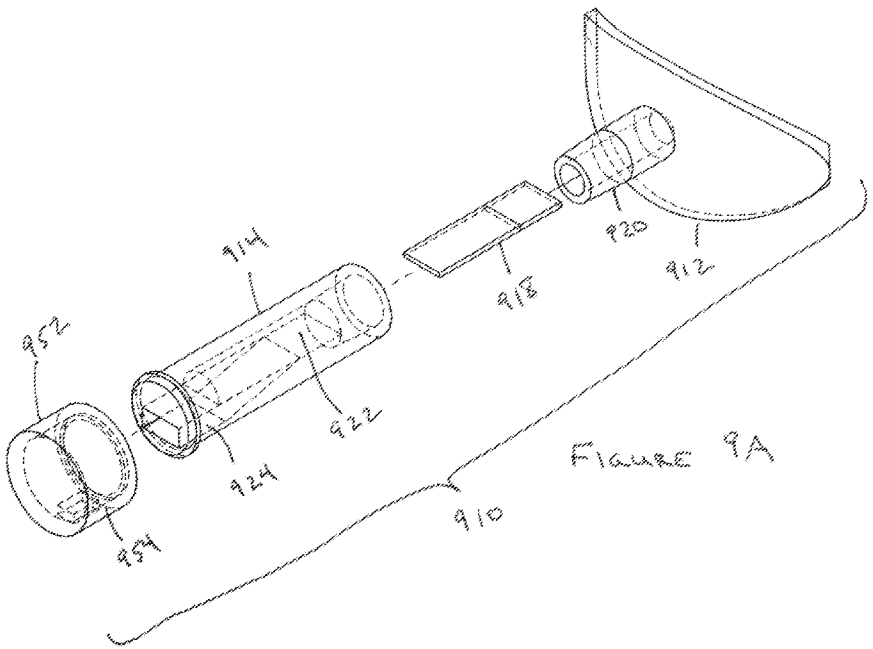
FIG. 9A is an exploded view of another head and neck exercise apparatus.
Figure 9B:
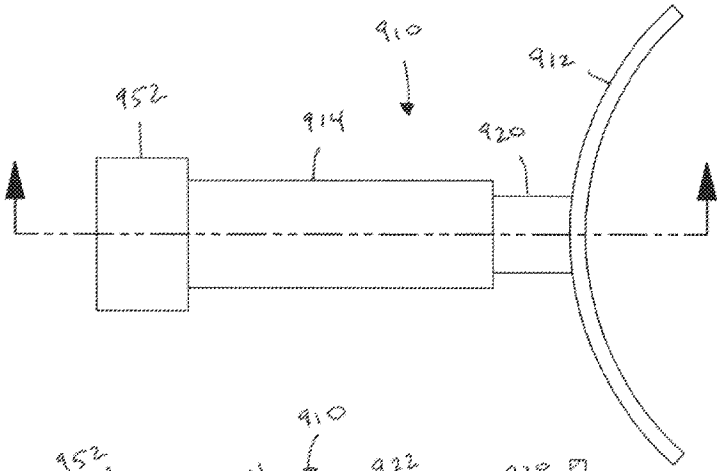
FIG. 9B is a top view of the assembled head and neck exercise apparatus in FIG. 9A.
Figure 9D:
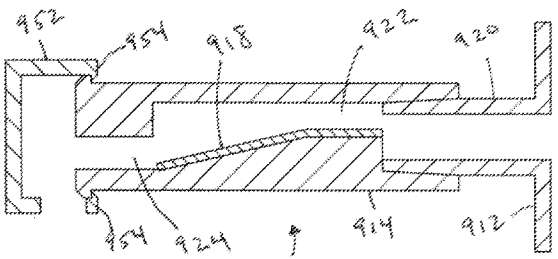
FIG. 9D is a cross-sectional side view of the assembled head and neck exercise apparatus in FIG. 9A with an open valve mechanism.
Figure 9C:
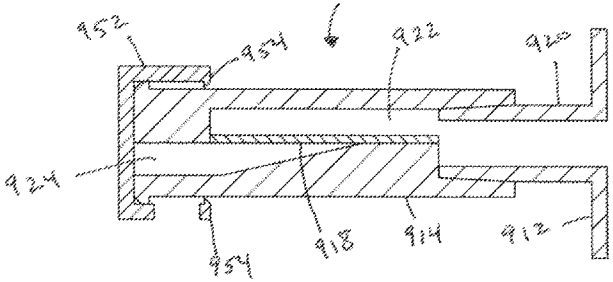
FIG. 9C is a cross-sectional side view of the assembled head and neck exercise apparatus in FIG. 9A with a closed valve mechanism.

The moveable element 952 may be configured such that it may be displaced when the valve mechanism 918 is open (FIG. 9D). In the current embodiment, the member 914 and moveable element 952 are both cylindrically-shaped, with the moveable element 952 having a larger diameter, but other configurations are possible (e.g., different cross-sectional shape, moveable element with smaller diameter, etc.). Displacement of the sliding element 952 may depend on the interaction between the sliding element 952 and member 914 (e.g. coefficient of friction, etc.). The moveable element 952 may include at least one stop 954 configured to limit the range of movement and reduce the chance of separation of the moveable element 952 and the member 914. Visible displacement of the moveable element 952 provides a straightforward means of user feedback during performance of a head and neck exercise. In other embodiments, the head and neck apparatus 910 may not include a valve mechanism 918, with the moveable element 952 configured such that it displaces only if the user generates sufficient positive or negative pressure within the proximal portion 922.

In other embodiments, the member 914 could incorporate at least one air passage opening (not shown) and a resistance adjustor (not shown), with all configurations described elsewhere in this application.

Head and neck exercises for sleep disordered breathing may include isotonic and/or isometric exercises that can involve muscles within and surrounding the oral cavity and/or pharynx. Methods have been proposed previously for head and neck exercises. These have generally not included the use of an apparatus or system. Some methods for head and neck exercises for sleep disordered breathing have included the use of apparatuses to brush or stroke the tongue or a single positive end-expiratory pressure valve with an adjustable threshold pressure, as described above.

Instead, printed, video, and/or audio materials may instruct the user in performance of a head and neck exercise for sleep disordered breathing using the apparatuses or system described elsewhere in this application. These materials may be pre-recorded or live and can be uniform or tailored to an individual or subgroup. After placement of the apparatus or system to the user's mouth, exercises may include the generation of positive or negative pressure within the head and neck apparatus or system. A user may be instructed to generate positive or negative pressure within the apparatus or system by activation of muscles of the oral cavity and/or pharynx. A user may also be instructed to generate positive or negative pressure within the apparatus or system by exhalation or inspiration. The instructions may present the technique for performance of the exercise, including possible modifications. The method of instructing the user may include any aspect of exercise performance such as repetitions, duration of time, use of feedback information to indicate proper performance, or other parameters.

Figure 10:
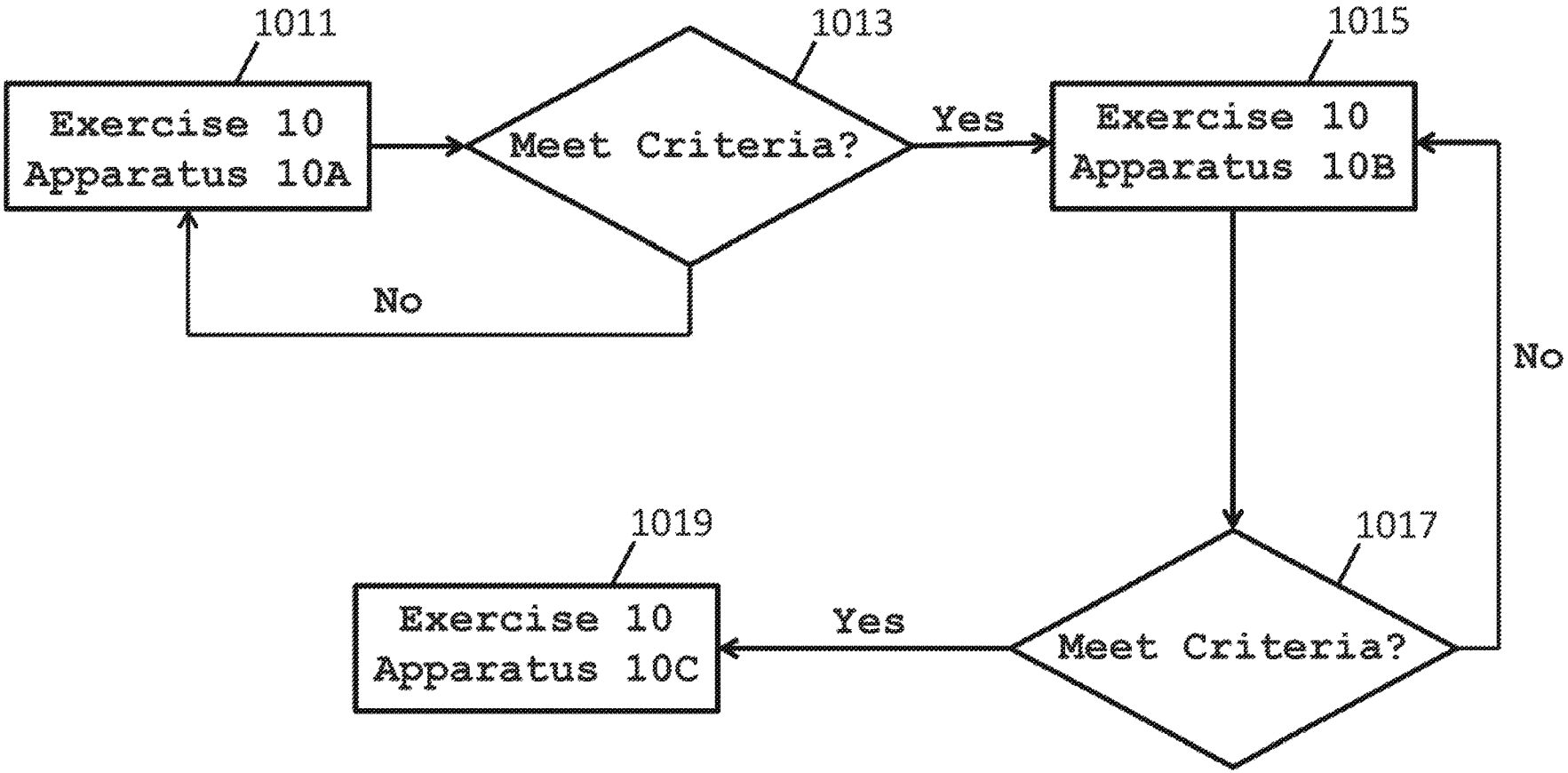
FIG. 10 is a flowchart of a method for instructing a user to perform a head and neck exercise.

Referring to FIG. 10, one embodiment of a method for instructing a user to perform head and neck exercises for sleep disordered breathing is shown. The user is instructed to perform an Exercise 10 with placement of an Apparatus 10A to the user's mouth and creation of a positive pressure within a proximal portion of Apparatus 10A. The Exercise 10 is performed with the creation of the positive pressure greater than a threshold pressure. Apparatus 10A (as well as the apparatus mentioned below) may correspond to any of the apparatus or head and neck exercise system configurations presented elsewhere in this application.

The method of instructing the user may match the features of any apparatus or system described elsewhere in this application. For example, a method may instruct a user to perform head and neck exercises for sleep disordered breathing while positioning a member defining an open proximal portion of a head and neck exercise apparatus to the user's mouth and creating a positive pressure within the proximal portion greater than a threshold pressure that is adjustable or not adjustable. The positive pressure may cause a valve mechanism operatively arranged with the member and biased towards a closed position to open when the positive pressure exceeds the threshold pressure such that the proximal portion is fluidly connected to a distal portion. The distal portion may include at least one of an acoustic device, membrane, chromogenic material, or moveable element, each operatively arranged with the member and configured to respond to a positive pressure in the proximal portion being greater in magnitude than the threshold pressure, and the method of instructing the user may indicate the response that should occur with proper performance of the exercise. The threshold pressure may be based on at least one of a stiffness of the valve mechanism, a dimension of the valve mechanism, or a dimension of the member.

In another embodiment, a method may instruct a user to perform head and neck exercises for sleep disordered breathing while positioning a member defining an open proximal portion of a head and neck exercise apparatus to the user's mouth and creating a negative pressure within the proximal portion less than a threshold negative pressure that is adjustable or not adjustable. The negative pressure may cause a valve mechanism operatively arranged with the member and biased towards a closed position to open when the negative pressure is less than the threshold negative pressure such that the proximal portion is fluidly connected to a distal portion. The distal portion may include at least one of an acoustic device, membrane, chromogenic material, or moveable element, each operatively arranged with the member and configured to respond to a negative pressure in the proximal portion being less than the threshold negative pressure, and the method of instructing the user may indicate the response that should occur with proper performance of the exercise. The threshold negative pressure may be based on at least one of a stiffness of the valve mechanism, a dimension of the valve mechanism, or a dimension of the member.

In another embodiment, a method may instruct a user to perform head and neck exercises for sleep disordered breathing while positioning a member defining an open proximal portion of a head and neck exercise apparatus to the user's mouth and creating a negative pressure within the proximal portion than is less than a threshold negative pressure. The negative pressure may cause a valve mechanism operatively arranged with the member and biased towards a closed position to open when the negative pressure is less than the threshold negative pressure such that the proximal portion is fluidly connected to a distal portion.

In another embodiment, a method may instruct a user to perform head and neck exercises for sleep disordered breathing while positioning a member defining an open proximal portion of a head and neck exercise apparatus to the user's mouth and creating a positive pressure within the proximal portion greater than a threshold positive pressure that is not adjustable. The positive pressure may cause a valve mechanism operatively arranged with the member and biased towards a closed position to open when the pressure exceeds the threshold positive pressure such that the proximal portion is fluidly connected to a distal portion.

In another embodiment, a method may instruct a user to perform head and neck exercises for sleep disordered breathing while positioning a member defining an open proximal portion of a head and neck exercise apparatus to the user's mouth and creating a positive pressure within the proximal portion greater than a threshold pressure. The positive pressure may cause a valve mechanism operatively arranged with the member and biased towards an open position to close when the positive pressure exceeds the threshold pressure such that this blocks the fluid connection between the proximal portion and a distal portion that exists when the valve mechanism is in the open position. The threshold pressure may be adjustable or not adjustable. The distal portion may include at least one of an acoustic device, membrane, chromogenic material, or moveable element, each operatively arranged with the member and configured to respond to a positive pressure in the proximal portion being greater in magnitude than the threshold pressure.

In another embodiment, a method may instruct a user to perform head and neck exercises for sleep disordered breathing while positioning a member defining an open proximal portion of a head and neck exercise apparatus to the user's mouth and creating a negative pressure within the proximal portion less than a threshold negative pressure. The negative pressure may cause a valve mechanism operatively arranged with the member and biased towards an open position to close when the negative pressure is less than the threshold negative pressure such that this blocks the fluid connection between the proximal portion and a distal portion that exists when the valve mechanism is in the open position. The threshold negative pressure may be adjustable or not adjustable. The distal portion may include at least one of an acoustic device, membrane, chromogenic material, or moveable element, each operatively arranged with the member and configured to respond to a negative pressure in the proximal portion being less than the threshold negative pressure.

In another embodiment, a method may instruct a user to perform head and neck exercises for sleep disordered breathing while positioning a member defining an open proximal portion of a head and neck exercise apparatus to the user's mouth and creating an absolute pressure within the proximal portion with a magnitude that exceeds a threshold absolute pressure. The threshold pressure may be adjustable or not adjustable. The apparatus may include at least one of an acoustic device, membrane, chromogenic material, or moveable element, each operatively arranged with the member and configured to respond to an absolute pressure in the proximal portion being greater in magnitude than the threshold absolute pressure. The apparatus may include at least one air passage opening. The apparatus may include an adjustment mechanism configured to alter an air resistance associated with the at least one air passage opening or dimensions of the at least one air passage opening.

One characteristic of the apparatuses and systems described in this application is the threshold pressure. A user may be instructed to perform Exercise 10 using Apparatus 10A having a first threshold pressure at block 1011. Once the user is able to perform the exercise and meet certain criteria at block 1013 (e.g., number of repetitions, duration, or other means of determining a level of function), the user may be instructed to perform Exercise 10 with Apparatus 10B at block 1015, distinguished from Apparatus 10A by having a different threshold pressure. Apparatus 10B may have a different configuration from Apparatus 10A (e.g., with and without valve mechanism, different feedback mechanism, etc.) or may represent a different portion of the head and neck exercise system. Once the user meets certain criteria in the performance of Exercise 10 using Apparatus 10B at block 1017, the user may be instructed to perform Exercise 10 with Apparatus 10C at block 1019, with all possible permutations described elsewhere in this application.

Figure 11:
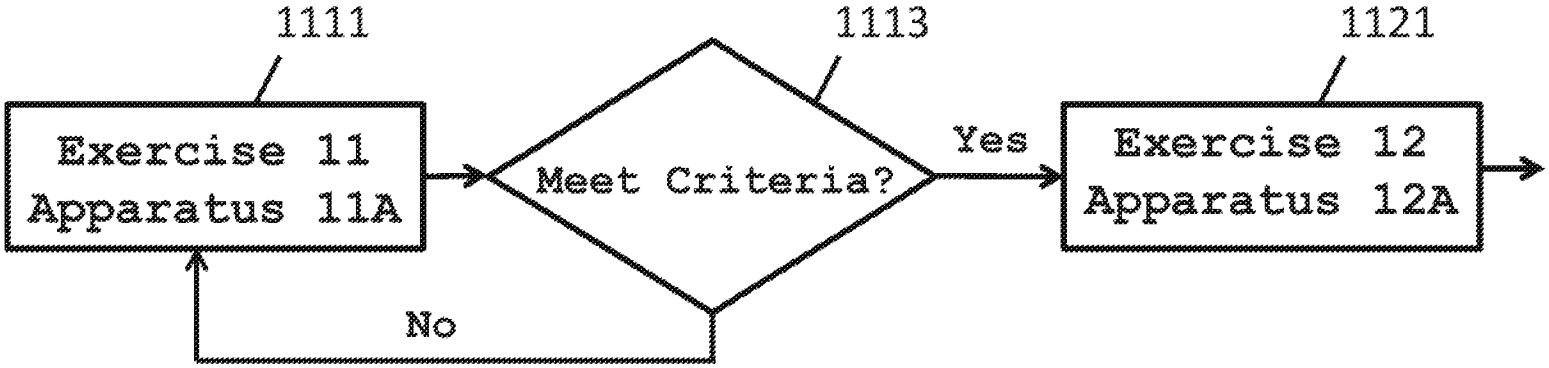
FIG. 11 is a flowchart of a method for instructing a user to perform another head and neck exercise.

Referring to FIG. 11, a user may be instructed to perform Exercise 11 with Apparatus 11A at block 1111. Once the user meets criteria at block 1113, the user may be instructed to perform Exercise 12 using Apparatus 12A at block 1121. Apparatus 12A may be distinguished from Apparatus 11A by having a different threshold pressure or different configuration from Apparatus 11A or may represent a different portion of the head and neck exercise system. The user may be instructed to modify the performance of this exercise using this apparatus or system according to whether they meet certain criteria (not shown), as described elsewhere in this application. In another embodiment, once the user meets criteria, the user may be instructed to perform the same or different exercise without using any apparatus or system.

The user may be instructed to perform multiple head and neck exercises for sleep disordered breathing with the use of the same apparatus or system. The user may also be instructed to perform head and neck exercises for sleep disordered breathing without the use of any apparatus or system.

Figure 12:
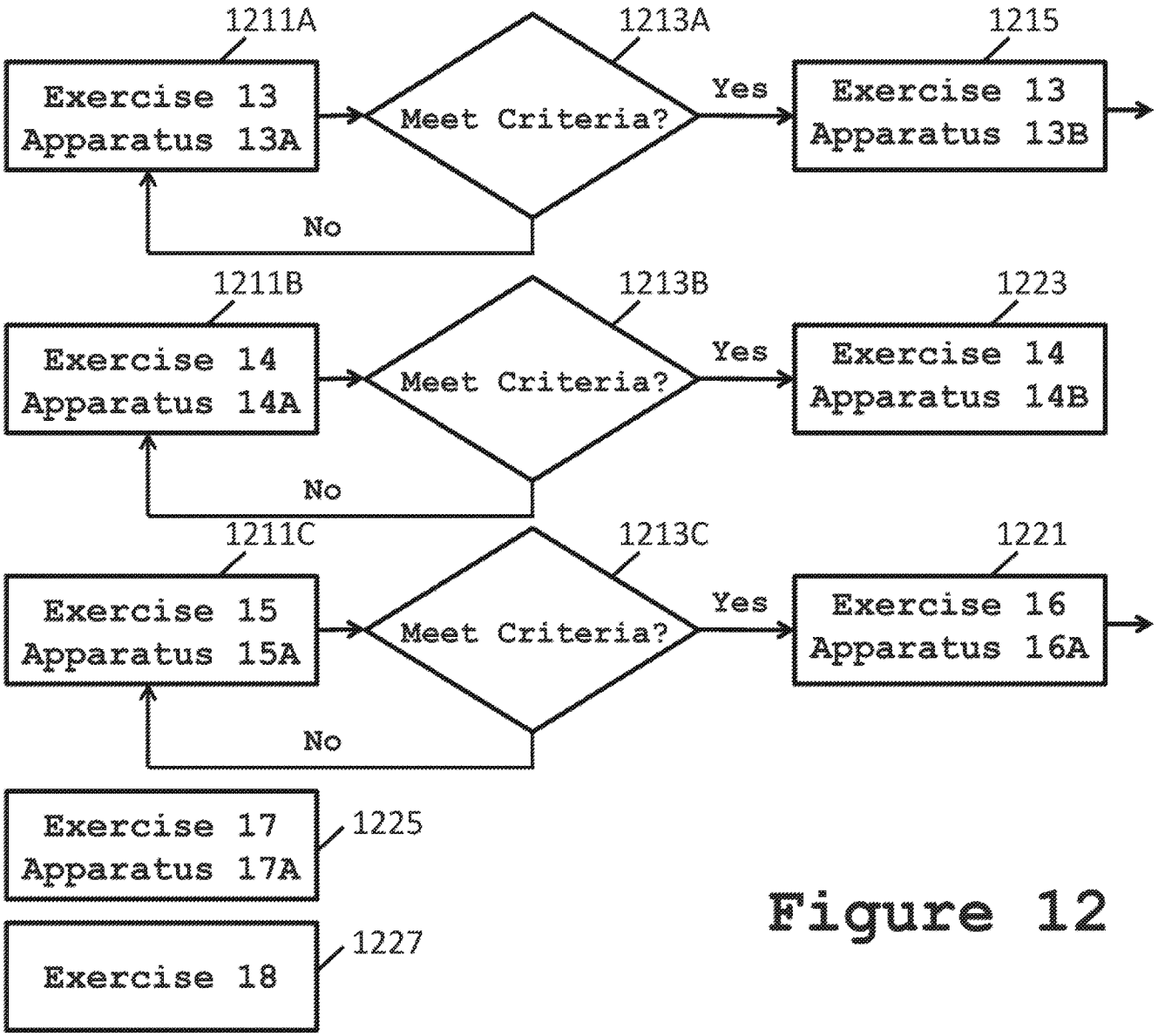
FIG. 12 is a flowchart of a method for instructing a user to perform a combination of head and neck exercises.

Referring to FIG. 12, the user may be instructed to perform a combination of head and neck exercises for sleep disordered breathing using at least one head and neck exercise apparatus or system. The apparatuses or systems may incorporate different configurations and/or different threshold pressures. The exercises may be designed to achieve a goal when performed together. For example, the user may be instructed to perform Exercise 13 with Apparatus 13A at block 1211A, progressing if they meet criteria at block 1213A to using Apparatus 13B at block 1215 and, possibly, Apparatus 13C (not shown), similar to FIG. 10. In a similar initial pattern, the user may be instructed to perform Exercise 14 with Apparatus 14A at block 1211B, with possible progression if they meet criteria at block 1213B to using Apparatus 14B at block 1223 but without additional progression. In a similar initial pattern, the user may be instructed to perform Exercise 15 with Apparatus 15A at block 1211C, with progression if they meet criteria at block 1213C to Exercise 16 and Apparatus 16A at block 1221 once the user meets certain criteria. The user may be instructed to perform Exercise 17 with Apparatus 17A at block 1225, without progression to another apparatus. The user may be instructed to perform Exercise 18 without the use of an apparatus at block 1227.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Moreover, certain embodiments may be used in head and neck exercises for other conditions or user concerns involving muscles and/or other tissues of the head and neck. Other conditions or user concerns can include disorders of speech or swallowing, skin wrinkles, fat in the head and neck, teeth grinding, facial pain, and mouth breathing.

What is claimed is:

1. A method for performing head and neck exercises with a head and neck exercise system including at least two different head and neck exercise apparatuses, wherein the at least two different head and neck exercise apparatuses include a first apparatus and a second apparatus, the method comprising:

positioning a member defining an open proximal portion of the first apparatus against a user such that the user is capable of breathing through the open proximal portion of the first apparatus;

performing by the user with the first apparatus a head and neck exercise in which the user generates, for a predetermined number of repetitions or duration of time selected to train head and neck muscles of the user to improve sleep disordered breathing, an absolute pressure within the open proximal portion of the first apparatus at a magnitude that exceeds a threshold absolute pressure of a valve mechanism, of the first apparatus, biased towards a closed position to cause the valve mechanism to open such that the open proximal portion of the first apparatus is fluidly connected to a distal portion of the first apparatus;

repeating the performing by the user the head and neck exercise with the first apparatus until first predefined criteria are met;

responsive to the first predefined criteria being met, positioning a member defining an open proximal portion of the second apparatus against the user such that the user is capable of breathing through the open proximal portion of the second apparatus;

performing by the user with the second apparatus the head and neck exercise, the second apparatus having a different valve mechanism or a different threshold absolute pressure than the first apparatus; and repeating the performing by the user the head and neck exercise with the second apparatus.

2. The method of claim 1, wherein performing the head and neck exercise with the second apparatus includes generating, for a predetermined number of repetitions or duration of time, an absolute pressure within the open proximal portion of the second apparatus at a magnitude that exceeds a threshold absolute pressure of a valve mechanism, of the second apparatus, biased towards a closed position to cause the valve mechanism to open such that the open proximal portion of the second apparatus is fluidly connected to a distal portion of the second apparatus to train head and neck muscles of the user.

3. The method of claim 1, wherein the first and the second apparatuses define a combined housing.

4. The method of claim 1, wherein the valve mechanism of the first apparatus is adjustable to alter the threshold absolute pressure.

5. The method of claim 1, wherein the first apparatus is configured to permit substitution of the Valve mechanism with a different valve mechanism.

6. The method of claim 1, wherein the valve mechanism of the second apparatus is adjustable to alter the threshold absolute pressure.

7. The method of claim 1, wherein the second apparatus is configured to permit substitution of the valve mechanism with a different valve mechanism.

8. The method of claim 1, further comprising selecting the first apparatus based on (i) an ability of the user to perform the head and neck exercise, using the first apparatus, for the predetermined number of repetitions or duration of time, (ii) an ability of the user to perform the head and neck exercise, using the first apparatus, for another predetermined number of repetitions or duration of time, (iii) an ability of the user to activate head and neck muscles with a muscle strength or muscle tension required to perform the head and neck exercise using the first apparatus, or (iv) the threshold absolute pressure of the first apparatus.

9. The method of claim 1, further comprising selecting the second apparatus based on (i) an ability of the user to perform the head and neck exercise, using the second apparatus, for the predetermined number of repetitions or duration of time, (ii) an ability of the user to perform the head and neck exercise, using the second apparatus, for another predetermined number of repetitions or duration of time, (iii) an ability of the user to activate head and neck muscles with a muscle strength or muscle tension required to perform the head and neck exercise using the second apparatus, or (iv) the threshold absolute pressure of the second apparatus.

10. A method for performing head and neck exercises with a head and neck exercise system including at least two different head and neck exercise apparatuses, wherein the at least two different head and neck exercise apparatuses include a first apparatus and a second apparatus, the method comprising:

positioning a member defining an open proximal portion of the first apparatus against a user such that the user is capable of breathing through the open proximal portion of the first apparatus, performing by the user with the first apparatus a head and neck exercise in which the user generates, for a predetermined number of repetitions or duration of time selected to train head and neck muscles of the user to improve sleep disordered breathing, an absolute pressure within the open proximal portion of the first apparatus at a magnitude that exceeds a threshold absolute pressure of a valve mechanism, of the first apparatus, biased towards an open position to cause the valve mechanism to close such that the open proximal portion of the first apparatus is separated from a distal portion of the first apparatus;

repeating the performing by the user the head and neck exercise with the first apparatus until first predefined criteria are met;

responsive to the first predefined criteria being met, positioning a member defining an open proximal portion of the second apparatus against the user such that the user is capable of breathing through the open proximal portion of the second apparatus, performing by the user with the second apparatus the head and neck exercise, the second apparatus having a different valve mechanism or a different threshold absolute pressure than the first apparatus; and repeating the performing by the user the head and neck exercise with the second apparatus.

11. The method or claim 10, wherein performing the head and neck exercise with the second apparatus includes generating, for a predetermined number of repetitions or duration of time, art absolute pressure within the open proximal portion of the second apparatus at a magnitude that exceeds a threshold absolute pressure of a valve mechanism, of the second apparatus, biased towards an open position to cause the valve mechanism to close such that the open proximal portion of the second apparatus is separated from a distal portion of the second apparatus to train head and neck muscles of the user.

12. The method of claim 10, wherein the first and the second apparatuses define a combined housing.

13. The method of claim 10, wherein the valve mechanism of the first apparatus is adjustable to alter the threshold absolute pressure.

14. The method of claim 10, wherein the first apparatus is configured to permit substitution of the valve mechanism with a different valve mechanism.

15. The method of claim 10, wherein the valve mechanism of the second apparatus is adjustable to alter the threshold absolute pressure.

16. The method of claim 10, wherein the second apparatus is configured to permit substitution of the valve mechanism with a different valve mechanism.

17. The method of claim 10, further comprising selecting the first apparatus based on (I) an ability of the user to perform the head and neck exercise, using the first apparatus, for the predetermined number of repetitions or duration of time, (an ability of the user to perform the head and neck exercise, using the first apparatus, for another predetermined number of repetitions or duration of time, (iii) an ability of the user to activate head and neck muscles with a muscle strength or muscle tension required to perform the head and neck exercise using the first apparatus, or (iv) the threshold absolute pressure of the first apparatus.

18. The method of claim 10, further comprising selecting the second apparatus based on (i) an ability of the user to perform the head and neck exercise, using the second apparatus, for the predetermined number of repetitions or duration of time, (ii) an ability of the user to perform the head and neck exercise, using the second apparatus, for another predetermined number of repetitions or duration of time, (iii) an ability of the user to activate head and neck muscles with a muscle strength or muscle tension required to perform the head and neck exercise using the second apparatus, or (iv) the threshold absolute pressure of the second apparatus.

19. A method for performing head and neck exercises with a head and neck exercise system including at least two different head and neck exercise apparatuses, wherein the at least two different head and neck exercise apparatuses include a first apparatus and a second apparatus, the method comprising:

positioning a member defining an open proximal portion of the first apparatus against a user such that the user is capable of breathing through the open proximal portion of the first apparatus, performing by the user with the first apparatus a head and neck exercise in which the user generates, for a predetermined number of repetitions or duration of time selected to train head and neck muscles of the user to improve sleep disordered breathing, an absolute pressure within the open proximal portion of the first apparatus at a magnitude that exceeds a threshold absolute pressure of the first apparatus to produce a response in a feedback mechanism of the first apparatus, the feedback mechanism including an acoustic device, a chromogenic material, a membrane, or a moveable element, the feedback mechanism being operatively arranged with the member of the first apparatus and configured to respond when the absolute pressure in the open proximal portion of the first apparatus is greater in magnitude than the threshold absolute pressure;

repeating the performing by the user the head and neck exercise with the first apparatus until first predefined criteria are met;

responsive to the first predefined criteria being met, positioning a member defining an open proximal portion of the second apparatus against the user such that the user is capable of breathing through the open proximal portion of the second apparatus performing by the user with the second apparatus the head and neck exercise, the second apparatus having, a different threshold absolute pressure or a different feedback mechanism than the first apparatus; and repeating the performing by the user the head and neck exercise with the second apparatus.

20. The method of claim 19, wherein performing the head and neck exercise with the second apparatus includes generating, for a predetermined number of repetitions or duration of time, an absolute pressure within the open proximal portion of the second apparatus at a magnitude that exceeds a threshold absolute pressure of the second apparatus to produce a response in the second apparatus.

21. The method of claim 19, wherein the first and the second apparatuses define a combined housing.

22. The method of claim 19, wherein the first apparatus is adjustable to alter the threshold absolute pressure.

23. The method of claim 19, wherein the first apparatus is configured to permit substitution of the feedback mechanism with a different feedback mechanism.

24. The method of claim 19, wherein the second apparatus is adjustable to alter the threshold absolute pressure.

25. The method of claim 19, wherein the second apparatus is configured to permit substitution of the feedback mechanism with a different feedback mechanism.

26. The method of claim 19, further comprising selecting the first apparatus based on (i) an ability of the user to perform the head and neck exercise, using the first apparatus, for the predetermined number of repetitions or duration of time, (ii) an ability of the user to perform the head and neck exercise, using the first apparatus, for another predetermined number of repetitions or duration of time, (iii) an ability of the user to activate head and neck muscles with a muscle strength or muscle tension required to perform the head and neck exercise using the first apparatus, or (iv) the threshold absolute pressure of the first apparatus.

27. The method of claim 19, further comprising selecting the second apparatus based on (i) an ability of the user to perform the head and neck exercise, using the Second apparatus, for the predetermined number of repetitions or duration of time, (ii) an ability of the user to perform the head and neck exercise, using the second apparatus, for another predetermined number of repetitions or duration of time, (iii) an ability of the user to activate head and neck muscles with a muscle strength or muscle tension required to perform the head and neck exercise using the second apparatus, or (iv) the threshold absolute pressure of the second apparatus.

* * * * *